United States Patent [19]

Kratzenberg et al.

[11] 4,155,285

[45] May 22, 1979

[54] MORTARS FOR FIRING SMOKE CANDLES AND EXPLOSIVE SHELLS

[75] Inventors: Karl-Heinz Kratzenberg, Staufenberg; Helmar Stobbe, Kassel; Günter Küllmer, Lohfelden, all of Fed. Rep. of Germany

[73] Assignee: Firma Wegmann & Co., Kassel, Fed. Rep. of Germany

[21] Appl. No.: 572,587

[22] Filed: Apr. 28, 1975

[30] Foreign Application Priority Data

Apr. 30, 1974 [DE] Fed. Rep. of Germany ..... 2420862

[51] Int. Cl.[2] ..... F41F 1/06

[52] U.S. Cl. ..... 89/1 F; 89/28 R

[58] Field of Search ..... 42/84; 89/1 F, 1 J, 89/1.814, 28, 135; 102/46; 200/16 L

[56] References Cited

U.S. PATENT DOCUMENTS

| | | | |
|---|---|---|---|
| 1,108,717 | 8/1914 | Davis | 89/28 R |
| 1,801,611 | 4/1931 | Norviel | 200/16 C |
| 3,081,701 | 3/1963 | Forquignon et al. | 102/46 |
| 3,128,670 | 4/1964 | Blacker | 102/46 |

*Primary Examiner*—Stephen C. Bentley

*Attorney, Agent, or Firm*—Sprung, Felfe, Horn, Lynch & Kramer

[57] ABSTRACT

An improvement in a pot mortar for electrically firing different types of ammunition charges said mortar having a mortar tube, the improvement residing in the mortar tube contains therewithin at least three electrical contacts for electrically contacting ammunition placed therein, one of which contacts is positioned to electrically fire a plurality of different types of ammunition, the other two of which are each positioned to electrically fire only one type of ammunition, each of said two electrical contacts positioned to fire a different type of ammunition.

1 Claim, 2 Drawing Figures

MORTARS FOR FIRING SMOKE CANDLES AND EXPLOSIVE SHELLS

BACKGROUND OF THE INVENTION

1. Field of the Invention

This invention relates to a pot mortar which can be used for firing different types of ammunition, e.g., smoke candles and explosive shells. More particularly, this invention relates to a pot mortar which can be used in connection with similar pot mortars, some of which are loaded with one type of ammunition and others of which are loaded with a different type of ammunition, electrical firing means being incorporated in each pot mortar in association with the desired type of ammunition. In accordance with the invention the pot mortars can all be fired to release the different types of ammunition or they can be fired to release one type of ammunition only.

2. Discussion of the Prior Art

Pot mortars are known for the firing of different types of ammunition, e.g., smoke candles or explosive shells. It often develops that it is desired to fire only the smoke candles or explosive shells. If the firing is performed by the use of an electrical ignition of the propellant charge care must be taken in connection with the known pot mortars to avoid the firing of the other type of ammunition. Thus if it is desired to fire the smoke candles care must be taken that those pot mortars equipped with explosive shells are not also fired.

It has become desireable, therefore, to provide in a pot mortar a system whereby maximum utilization of the pot mortar is achieved allowing the pot mortar to be fired in conjunction with other pot mortars to fire only certain types of ammunition charges or to fire all ammunition charges without regard to the type of explosive charge contained within the pot mortar.

SUMMARY OF THE INVENTION

In accordance with this invention there is provided an improved pot mortar for electrically firing different ammunition charges said pot mortar having a mortar tube, the improvement residing in that said mortar tube contains therewithin at least three electrical contacts for contacting ammunition placed therein, one of which contacts is positioned to electrically fire a plurality of different types of ammunition, the other two of which are each positioned to electrically fire only one type of ammunition, each of said two electrical contacts positioned to fire a different type of ammunition.

In the apparatus of the present invention the ammunition to be fired from the mortar is, in known manner provided with two contact rings which are so arranged that, when the mortar is loaded, one contact ring will be in electrically conductive contact with a contact in the mortar tube which is associated with both types of ammunition, while the second contact ring will be in electrically conductive contact only with that contact which is associated with the particular type of ammunition. Thus when the electrical ignition corresponding only to that ammunition is fired only those pot mortars in association with one another containing that particular ammunition are fired. This means, in operation, that only smoke candles or explosive shells are fired and pot mortars loaded with the other type of shells remain unfired.

Should it be desired that pot mortars equipped with different types of ammunition be fired at the same time that which corresponds to both types of ammunition is fired thereby releasing from the pot mortars all of the ammunition regardless of type.

The present invention functions particularly well in connection with battle vehicles which are equipped with pot mortars from which smoke candles or explosive shells can be fired to knock out enemies in the immediate vicinity of the vehicle. In these battle vehicles firing is accomplished through the use of an electrical ignition of a propellant charge, contacts being provided within the mortar tube which make an electrically conductive contact with contact rings on the mortar cartridge within the pot mortar.

Heretofore, it was experienced that the firing system was so wired that a plurality of mortars were fired simultaneously. If in this case the mortars are loaded with different kinds of ammunition, e.g., some with smoke candles and others with explosive shells, no provision was provided for firing only one type of projectile. For instance, if explosives only were to be fired but visibility must not be hampered by release of the vehicle's own smoke candles, or if, on the other hand, only smoke candles were to be fired because the vehicle is seeking to be obscured from the enemy no provision was made for such selective firing. The pot mortar of the present invention allows the firing of the smoke candles and/or explosive shells to accomplish the intended objective. The present invention thus provides an electrical firing system whereby mortars can be fired individually or in groups and obviates complicated electrical installation and the maintenance of great care during the firing.

In accordance with the invention by the disposition within each mortar tube of three electrical contacts, one of which is associated with both types of ammunition and the other two of which are each associated with only one type of ammunition it is possible to fire one or both types of ammunition. The projectile to be fired from this mortar is, of course, provided with two contact rings in each case which are so arranged that one contact ring is in electrical contact with the contact in the mortar which is associated with both types of ammunition while the second contact ring is in electrically conductive contact only with the contact associated with this particular type of ammunition.

Within the vehicle, therefore, only two firing controls are necessary, one producing the firing of smoke candles, the other producing the firing of mortar shells. In this manner the advantage is achieved that when loading and firing no special care need be taken as to which mortars are loaded with smoke candles and which are loaded with explosive shells. In either event mortars which are loaded with smoke and mortars which are loaded with explosive shells will fire together only when it is desired. When it is desired to fire only one thereof only that electrical contact corresponding to the desired type of ammunition is actuated an only that type of ammunition is fired.

BRIEF DESCRIPTION OF THE DRAWINGS

In order to more fully illustrate the invention, reference is made to the accompanying drawings in which.

DESCRIPTION OF SPECIFIC EMBODIMENTS

Figure 1:
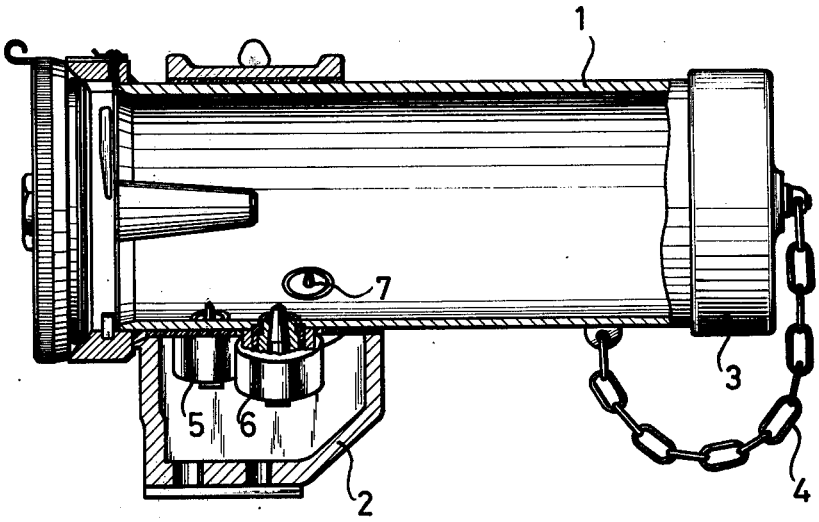
FIG. 1 is a longitudinal section of a pot mortar according to the invention.
Figure 2:
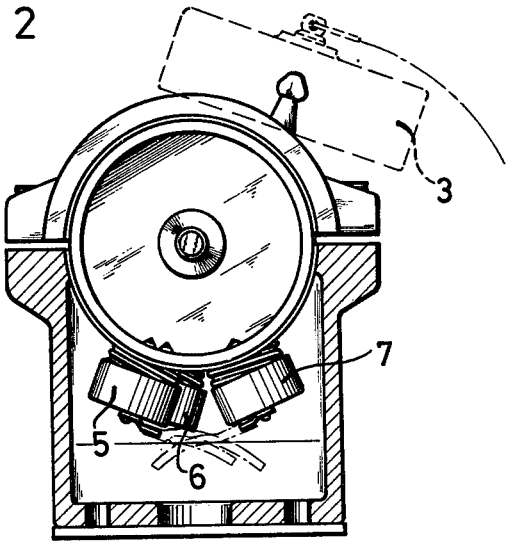
FIG. 2 is a cross-sectional view of the pot mortar of FIG. 1.

Referring to the drawings, a mortar tube 1 is fastenend in known manner to a mortar tube mounting 2. The mouth of the tube is closed with a cap 3 which is attached to the tube by a chain 4. Within the mortar tube there are three sets of contacts, 5, 6 and 7 each disposed in accordance with the invention. These contacts consist of a contact pin with a power conductor soldered thereto and a compression spring. On the ammunition to be fired (not shown) there are contact rings which are so arranged that, in the case of smoke candles, for example, the contact rings are in electrically conductive contact with contacts 6 and 7. For firing explosive shells, the explosive shells are provided with contact rings somewhat differently positioned around their circumference so that they will be in contact with contacts 5 and 6.

It is easily apparent that, when the firing control device connects contacts 7 and 6 to the voltage source, only the smoke candles will be fired, but when contacts 5 and 6 are connected to the voltage source only the explosive shells will be fired. When all three contacts are connected to the voltage source both types of ammunition will be fired.

What is claimed is:

1. In a pot mortar for electrically firing different types of ammunition, each type of which is provided with two contact rings at different portions on the ammunition from one another; the improvement wherein the pot mortar contains therein at least three electrical contacts for contacting with the two contact rings of the ammunition placed therein, one of said electrical contacts of said pot mortar being positioned to contact both types of ammunition at one of the two contact rings, one of the remaining contacts of said pot mortar being positioned so that it contacts only one of the remaining contact rings of a certain type of ammunition, the other said remaining contacts of said pot mortar being positioned so that it contacts only one of the remaining contact rings of a different type of ammunition, whereby each of the remaining of said electrical contacts is positioned to electrically fire only one different type of ammunition.

* * * * *